US009901800B2

(12) United States Patent
Castillo, Jr.

(10) Patent No.: US 9,901,800 B2
(45) Date of Patent: Feb. 27, 2018

(54) BALL THROWING TRAINING AND STRENGTHENING DEVICE

(71) Applicant: Jesse Castillo, Jr., Granada Hills, CA (US)

(72) Inventor: Jesse Castillo, Jr., Granada Hills, CA (US)

( * ) Notice: Subject to any disclaimer, the term of this patent is extended or adjusted under 35 U.S.C. 154(b) by 0 days.

(21) Appl. No.: 15/650,802

(22) Filed: Jul. 14, 2017

(65) Prior Publication Data

US 2017/0312606 A1 Nov. 2, 2017

Related U.S. Application Data

(60) Division of application No. 14/708,180, filed on May 8, 2015, which is a continuation-in-part of application No. 14/157,203, filed on Jan. 16, 2014, now abandoned, application No. 15/650,802, which is a division of application No. 14/157,203, filed on Jan. 16, 2014, now abandoned.

(60) Provisional application No. 61/904,917, filed on Nov. 15, 2013.

(51) Int. Cl.
*A63B 69/00* (2006.01)

(52) U.S. Cl.
CPC ..... *A63B 69/0002* (2013.01); *A63B 69/0091* (2013.01); *A63B 2069/0006* (2013.01); *A63B 2208/0204* (2013.01); *A63B 2225/09* (2013.01)

(58) Field of Classification Search
CPC ..... A63B 69/0002; A63B 69/0004; A63B 69/0091; A63B 2069/0008; A63B 2069/0006; A63B 15/00; A63B 69/0088; A63B 21/072; A63B 21/0722; A63B 21/0724; A63B 21/0726; A63B 69/004; F41B 15/00; F41B 15/027
USPC ..... 473/424, 423, 458, 425, 451–454; 463/47.2–47.7; 482/106–109
See application file for complete search history.

(56) References Cited

U.S. PATENT DOCUMENTS

| | | | | | |
|---|---|---|---|---|---|
| 3,152,803 | A * | 10/1964 | Sain, Jr. | A63B 69/0002 | 434/247 |
| 4,846,471 | A * | 7/1989 | Haysom | A63B 69/0002 | 473/451 |
| 5,092,588 | A * | 3/1992 | DeLuca | A63B 21/072 | 482/109 |
| 5,830,091 | A * | 11/1998 | Romanick | A63B 43/00 | 473/451 |
| 6,024,660 | A * | 2/2000 | Romanick | A63B 43/00 | 473/451 |
| 7,699,724 | B1 * | 4/2010 | Derisse | A63B 21/153 | 473/422 |
| 7,951,020 | B2 * | 5/2011 | Castor | A63B 21/0602 | 473/451 |
| 7,955,197 | B2 * | 6/2011 | Roudybush | A63B 15/00 | 473/424 |
| 8,506,427 | B2 * | 8/2013 | Webb | A63B 69/0002 | 473/422 |
| 2002/0020217 | A1 * | 2/2002 | Imatoh | A63B 15/00 | 73/379.01 |

(Continued)

*Primary Examiner* — Mark Graham
(74) *Attorney, Agent, or Firm* — Cislo & Thomas, LLP; Laura M. Lloyd

(57) ABSTRACT

This invention relates generally to training a user how to correctly throw a ball, and more specifically, a training, physical, or occupational therapy aid that can be used to strengthen and rehabilitate a user's muscles and joints.

8 Claims, 12 Drawing Sheets

(56) References Cited

U.S. PATENT DOCUMENTS

| | | | | |
|---|---|---|---|---|
| 2004/0171440 | A1* | 9/2004 | Cataldi, Jr. | A63B 43/007 473/451 |
| 2007/0105663 | A1* | 5/2007 | Farnsworth | A63B 15/00 473/422 |
| 2007/0123370 | A1* | 5/2007 | Goucher | A63B 69/0002 473/451 |
| 2010/0120591 | A1* | 5/2010 | Shaterian | A61H 15/0092 482/106 |
| 2013/0344997 | A1* | 12/2013 | DiMichele, Jr. | A63B 69/0002 473/424 |
| 2014/0287852 | A1* | 9/2014 | Clark | A63B 69/0002 473/424 |
| 2015/0018132 | A1* | 1/2015 | Lovelace | A63B 69/0002 473/458 |
| 2015/0231473 | A1* | 8/2015 | Vittozzi | A63B 69/0002 473/451 |

* cited by examiner

BALL THROWING TRAINING AND STRENGTHENING DEVICE

CROSS-REFERENCE TO RELATED APPLICATIONS

This application a divisional of U.S. patent application Ser. No. 14/708,180 titled "Ball Throwing Training and Strengthening Device" filed May 8, 2015, which is a continuation-in-part of U.S. patent application Ser. No. 14/157,203 for "Ball Throwing Training and Strengthening Device" filed on Jan. 16, 2014, which claims the benefit of U.S. Provisional Patent Application No. 61/904,917 for "Ball Throwing Training Device" filed on Nov. 15, 2013; and is also a divisional of U.S. patent application Ser. No. 14/157,203, which claims the benefit of U.S. Provisional Patent Application No. 61/904,917 filed Nov. 15, 2013, the contents of which are incorporated herein by reference in their entirety.

BACKGROUND OF THE INVENTION

Many people have the desire for correcting the way they throw a ball. In the sport of baseball, it is common for pitchers to have poor form when pitching the ball. One of the most common improper ways of pitching a ball is termed a "side arm." Repetitive side arm motions can result in debilitating deterioration of the elbow joint and ligament, otherwise known as a Tommy John, affectionately named after the first baseball player to undergo surgery for this type of injury. This injury ultimately requires invasive surgery to repair the elbow joint and ligament. Surgery required for correcting this injury is known as ulnar collateral ligament reconstruction. In the event that the surgery is not successful, the player's career could end.

Also problematic is the injury that young ball players can sustain from an improper throwing technique. If the growth plate, the medial epicondylar epiphysis, is still open, repeatedly throwing in a side arm fashion will exert excessive force on the growth plate and cause failure in this location, rather than at the ulnar collateral ligament. This injury is commonly known as "Little League Elbow," and although it does not require reconstruction of the ulnar collateral ligament, it is still a very devastating injury for a young ball player to sustain. However, injuries caused by improper throwing techniques can be prevented by the use of correct throwing techniques.

Currently, there are devices available, such as an elbow brace, which assists with correctly positioning the arm during ball throwing. There are also devices available for strengthening the arm or shoulder. In addition, there are devices available that assist the user with throwing a ball or other object across a distance. However, these devices do not assist with training a user to improve or correct their throw, or to strengthen a user's arm or shoulder after an injury. Consequently, there is a need for a ball throwing training device that is easy and intuitive to use.

The present invention overcomes several of the deficiencies, disadvantages and undesired parameters associated with known ball throwing training apparatuses.

SUMMARY OF THE INVENTION

The invention is a unique ball throwing training device. The ball throwing training device has a longitudinal body portion containing a proximal end and a distal end. The device also has an end cap coupled to the proximal end of the longitudinal body portion and a first ball shaped object coupled to the distal end of the longitudinal body portion. In one embodiment of the ball throwing training device, the longitudinal body portion is made from an inflexible material. The inflexible material can be fiberglass, metal, plastic or wood. Additionally, the longitudinal body portion can be made up of two or more longitudinal body portions of variable size. The two or more longitudinal body portions of variable size can be joined together by any means. Optionally, the longitudinal body portion can have a moveable portion proximate to the distal end of the longitudinal body portion. The moveable portion can be a pivot joint, a flexible portion, or a spring mechanism. The moveable portion can also have a locking mechanism to prevent the moveable portion from moving or bending. The first ball-shaped object can be coupled to the distal end of the longitudinal body portion via mechanical means. The mechanical means can be a screw, nail, clip, snap, ball joint, or an adhesive. The first ball-shaped object can be any size. Optionally, the first ball-shaped object can be a ball, such as, for example, a baseball, a softball, a tennis ball, or a football. The end cap can be coupled to the proximal end of the longitudinal body portion. Additionally, the end cap can move between a retracted position and an extended position. Optionally, the end cap can comprise a second ball-shaped object and the second ball-shaped object can be any size. The second ball-shaped object can be a ball, and it could be a baseball, a softball, a tennis ball, or a football. The second ball-shaped object can be coupled to the proximal end of the longitudinal body portion via mechanical means. The mechanical means can be a screw, nail, clip, snap, ball joint, or adhesive. Optionally, a strap can be coupled to the device and the user.

In another embodiment of the ball throwing training device, the device has a first longitudinal body portion having a proximal end and a distal end, a first flexible portion having a proximate end and a distal end wherein the proximal end of the first flexible portion is coupled to the distal end of the first longitudinal body portion, a second longitudinal body portion having a proximal end and a distal end wherein the proximal end of the second longitudinal body portion is coupled to the distal end of the first flexible portion, a second flexible portion having a proximal end and a distal end, wherein the proximal end of the second flexible portion is coupled to the distal end of the second longitudinal body portion, and a first ball-shaped object coupled to the distal end of the second flexible portion. Optionally, the device can also have a third longitudinal body portion having a proximal end and a distal end, wherein the proximal end of the third longitudinal body portion is coupled to the distal end of the second flexible portion and the first ball shaped object is coupled to the distal end of the third longitudinal body portion. Additionally, the first and second longitudinal body portions can be made from inflexible material. The inflexible material can be fiberglass, metal, plastic or wood. The first and second flexible portions can also have a locking mechanism which prevents the first and second flexible portions from flexing. Optionally, the device can also have an end cap coupled to the proximal end of the first longitudinal body portion. Additionally, the end cap move between a retracted position and an extended position. Optionally, the end cap can comprise a second ball-shaped object and the second ball-shaped object can be any size. The second ball-shaped object can be a ball, and it could be a baseball, a softball, a tennis ball, or a football. The second ball-shaped object can be coupled to the proximal end of the longitudinal body portion via mechanical means. The mechanical means can be a screw, nail, clip, snap, ball joint, or adhesive. Optionally, a strap can be coupled to the device and the user.

The invention is also a method of using the ball throwing training device. The method of using the ball throwing training device includes the steps of first grasping the first ball-shaped object in the user's hand, placing the longitudinal body portion underneath the user's arm and against the user's side, then placing the proximal end of the longitudinal body portion against the lower back of the user such that the user's hand holding the first ball-shaped object is above shoulder height and rotating the user's arm such that the hand holding the first ball-shaped object rotates from above the user's shoulder height to below the user's shoulder. The rotation of the user's arm forward lifts the proximal end of the longitudinal body portion.

The invention can also be used as an arm and shoulder strengthening device. The strengthening device has a longitudinal body portion and a first ball-shaped object. The longitudinal body portion has a proximal end and a distal end and the first ball-shaped object is coupled to the distal end of the longitudinal body portion. Optionally, the longitudinal body portion can be made up of two or more longitudinal body portions of variable size. The arm strengthening device can also have a second ball-shaped object coupled to the proximal end of the longitudinal body portion. Optionally, a strap can be coupled to the device and the user.

DRAWINGS

These and other features, aspects and advantages of the present invention will become better understood with reference to the following description, appended claims, and accompanying drawings where:

DETAILED DESCRIPTION OF THE INVENTION

Definitions

As used herein, the following terms and variations thereof have the meanings given below, unless a different meaning is clearly intended by the contest in which such term is used.

The terms "a," "an," and "the" and similar referents used herein are to be construed to cover both the singular and the plural unless their usage in context indicates otherwise.

As used in this disclosure, the term "comprise" and variations of the term, such as "comprising" and "comprises," are not intended to exclude other additives, components, integers ingredients or steps.

The following discussion describes in detail one embodiment of the invention and several variations of that embodiment. This discussion should not be construed, however, as limiting the invention to those particular embodiments. Practitioners skilled in the art will recognize numerous other embodiments as well.

Ball Throwing Training Device

The device described herein can be used as a ball throwing training device used to train a user to correctly throw a ball, or as an arm and shoulder strengthening device. The device can also be used in physical or occupational therapy as an aid to strengthen a user's arm and shoulder. In use, the device engages the user's arm, shoulder, neck and trunk muscles, such as, for example, forearm flex muscles, forearm extensor muscles, biceps, triceps, deltoids, chest muscles, side muscles, and trapezius muscles.

It is contemplated that adults and children of any size can use the device.

Figure 1A:
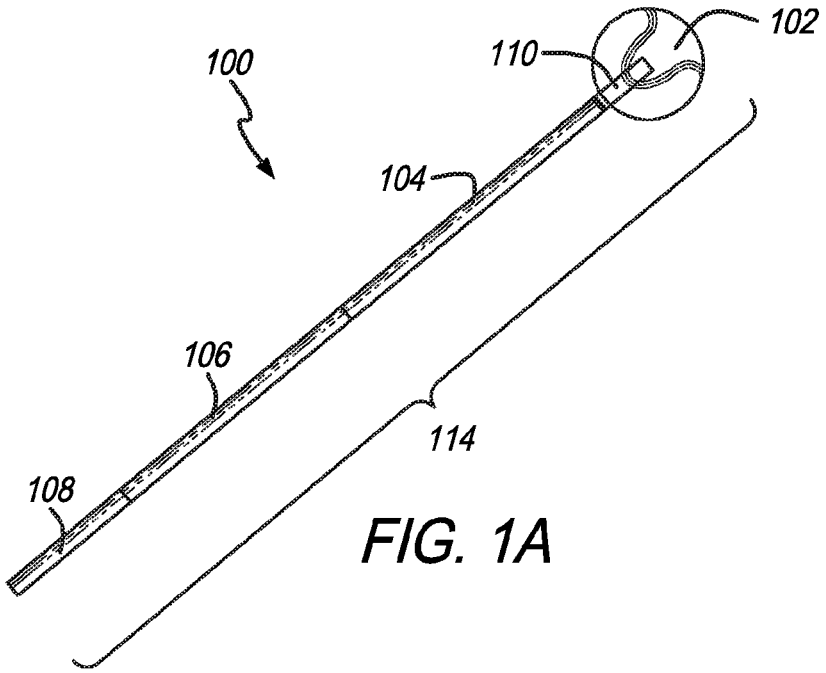
FIGS. 1A and 1B are diagrams of a ball throwing training device.
Figure 1B:
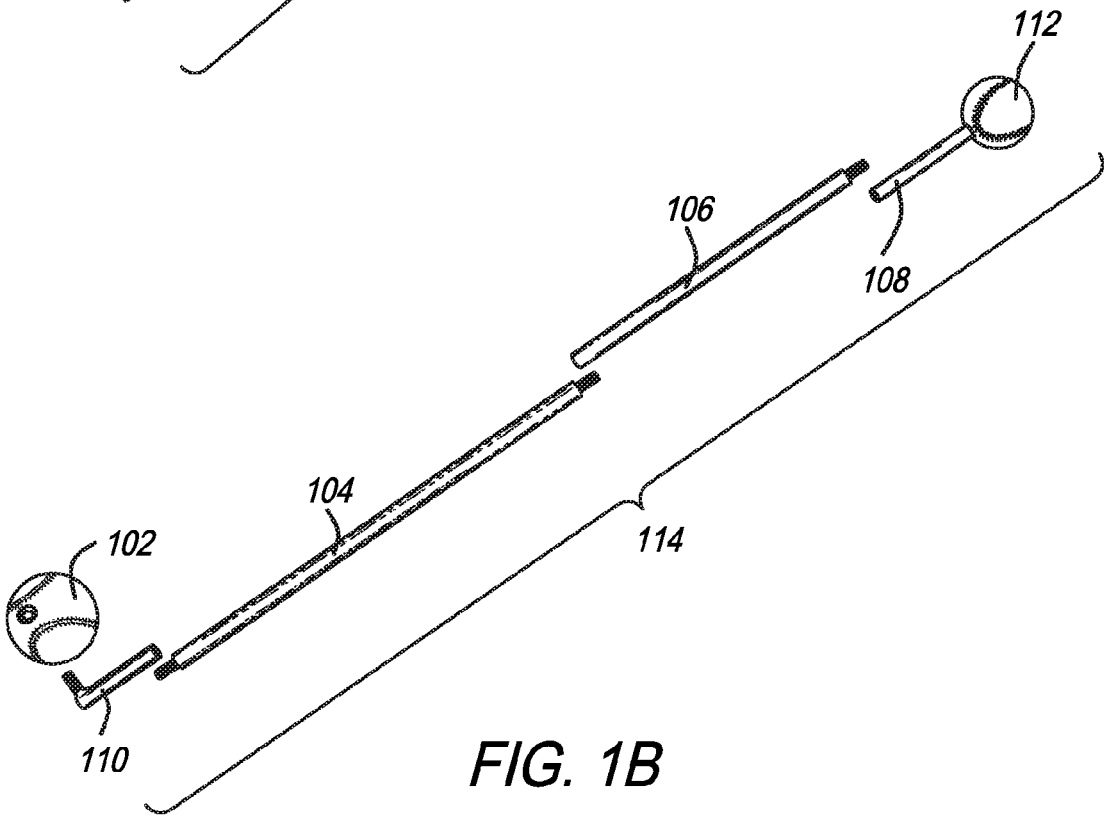

FIGS. 1A and 1B show diagrams of a ball throwing training device 100. The ball throwing training device has a longitudinal body portion 114 and a first ball-shaped object 102 coupled to the longitudinal body portion. The head portion 110 couples the first ball-shaped object to the longitudinal body portion 114. The length of longitudinal body portion 114 can be extended or shortened to accommodate users of different sizes and physiology. The longitudinal body portion 114 can be made up of one body portion, or it can be segmented and made up of different sized longitudinal body portions as shown by first segmented longitudinal body portion 104, second segmented longitudinal body portion 106, and third segmented longitudinal body portion 108. The different sized first, second and third segmented longitudinal body portions 104, 106, 108 can be coupled together to form the longitudinal body portion 114. The size and number of segmented longitudinal body portions can be combined as desired by the user. FIG. 1B shows an example of how first, second and third segmented longitudinal body portions 104, 106, 108 can be coupled to the head portion 110 containing the first ball-shaped object 102.

As an example, for a ball throwing device of 33 inches long, the first segmented longitudinal body portion 104 can be 14 inches long, the second segmented longitudinal body portion 106 can be 12 inches long, the third segmented longitudinal body portion 108 can be 4 inches long, and the head portion 110 can be 3 inches long.

The longitudinal body portion 114 can be of any size needed so that the user of the ball throwing training device 100 can comfortably hold the first ball-shaped object 102 while the proximal end of the longitudinal body portion 114 rests on the user's lower back. It is contemplated that the longitudinal body portion 114 can be adjusted to accommodate the height of the user. Optionally, the longitudinal body portion 114 can comprise a telescoping form, such that the first, second and third segmented body portions 104, 106, 108, and the head portion 110 retract into each other, making transportation of the device very easy.

The longitudinal body portion 114, the first, second and third segmented longitudinal body portions 104, 106 and 108, and the head portion 110 can be made from any inflexible material such as, for example, fiberglass, metal, plastic, wood, aluminum, steel, carbon fiber, steel alloy, copper tubing, bamboo, paper, glue, rubber, glass, tin, leather or brass.

The first ball-shaped object 102 can be made from any material. For example, the first ball-shaped object 102 can be made from foam, metal, plastic, rubber, glass, leather, aluminum, tin, wood, or brass. It is contemplated that the first ball-shaped object 102 will be in the form of a ball used in a sporting event, such as, for example, a baseball, football, tennis ball, soft ball, golf ball, basketball volleyball, and racquet ball. The first ball-shaped object 102 can also be a squeeze ball, a glow in the dark ball, a marble, or a weighted ball.

Figure 10:
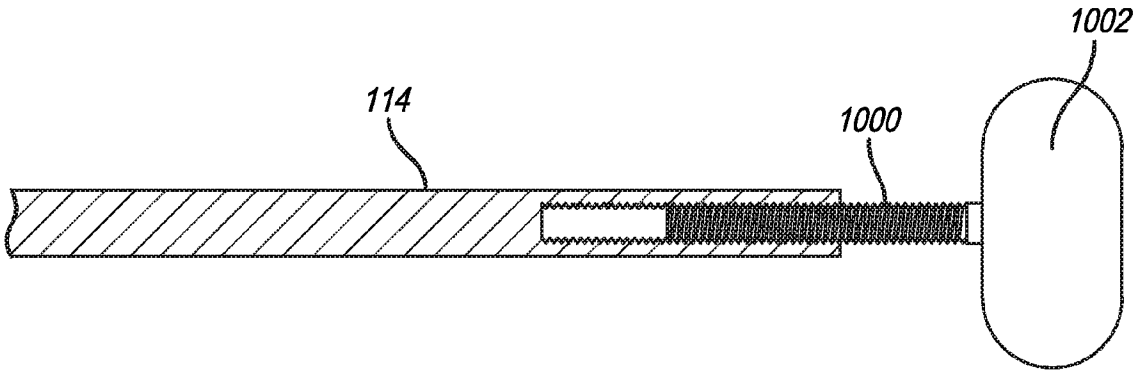
FIG. 10 is a diagram of an end cap affixed to the ball throwing training device, wherein the end cap is in an extended position.
Figure 11:
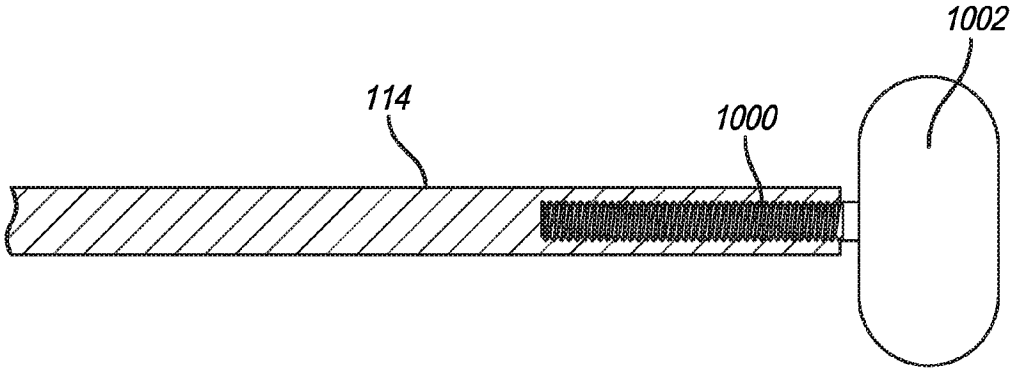
FIG. 11 is a diagram of the end cap affixed to the ball throwing training device, wherein the end cap is in a retracted position.

Referring now to FIGS. 10 and 11, in one embodiment of the ball throwing training device 100, the proximal end of a longitudinal body portion 114 can be optionally coupled to an end cap 1002. The end cap 1002 can be made from any material such as, for example, foam, metal, plastic, rubber, glass, leather, aluminum, tin, wood, or brass. Additionally, the end cap 1002 can be any size and shape. Optionally, as can be seen in FIGS. 10 and 11, the end cap 1002 can move between an extended position, as illustrated in FIG. 10, and a retracted position as illustrated in FIG. 11. The end cap 1002 can move via any mechanical means, but preferably the end cap 1002 is moveable via a threaded mechanism 1000, which permits the end cap 1002 to move between the extended position and the retracted position via rotating the end cap 1002 in one direction or the other. This feature is beneficial because it allows the ball throwing training device 100 to be easily and quickly adjustable to accommodate users of different size and height.

Optionally, the end cap 1002 can be a second ball-shaped object 112. The second ball-shaped object 112 can be made from any material such as, for example, foam, metal, plastic, rubber, glass, leather, aluminum, tin, wood, or brass. It is contemplated that the most common second ball-shaped object 112 will be in the form of a ball used in a sporting event such as, for example, a baseball, football, tennis ball, soft ball, golf ball, basketball, volleyball, and racquet ball. The second ball-shaped object 112 can also be a squeeze ball, a glow in the dark ball, a marble, or a weighted ball.

Figure 12:
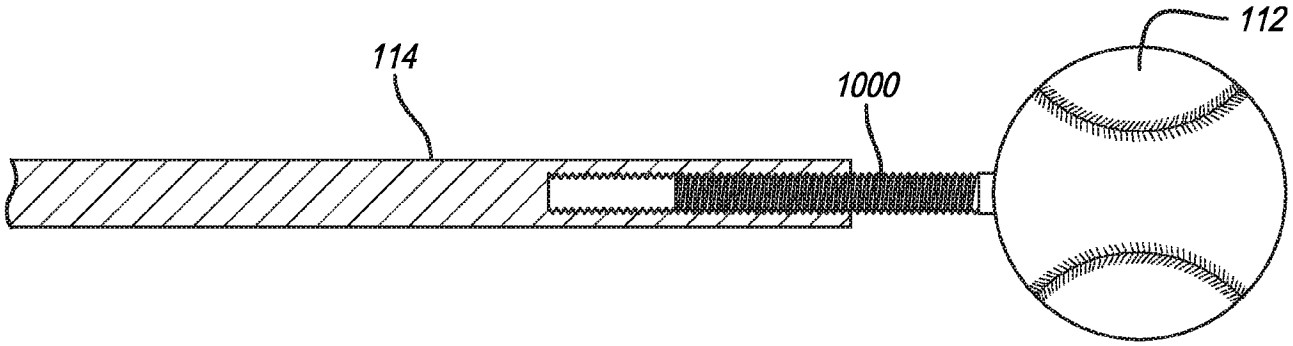
FIG. 12 is a diagram of a second ball shaped object affixed to the ball throwing training device, wherein the second ball shaped object is in an extended position.
Figure 13:
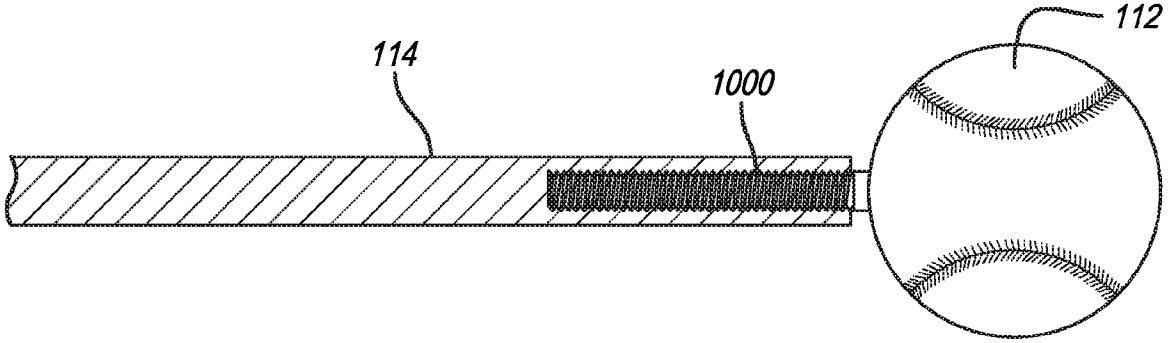
FIG. 13 is a diagram of the second ball shaped object affixed to the ball throwing training device, wherein the second ball shaped object is in a retracted position.

As can be seen in FIGS. 12 and 13, the second ball shaped object 112 can move in the same fashion as the end cap 1002, in that it has an extended position as shown in FIG. 12 and a retracted position as shown in FIG. 13.

Figure 2A:
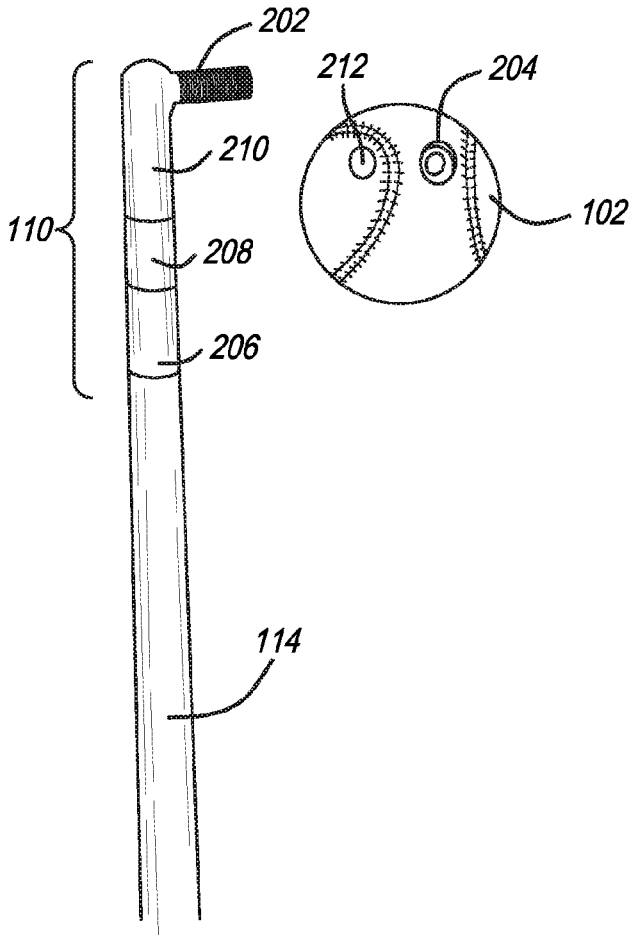
FIGS. 2A and 2B are diagrams of an example of the mechanical means by which the first ball-shaped object is coupled to the distal end of the stick portion of the ball throwing training device.
Figure 2B:
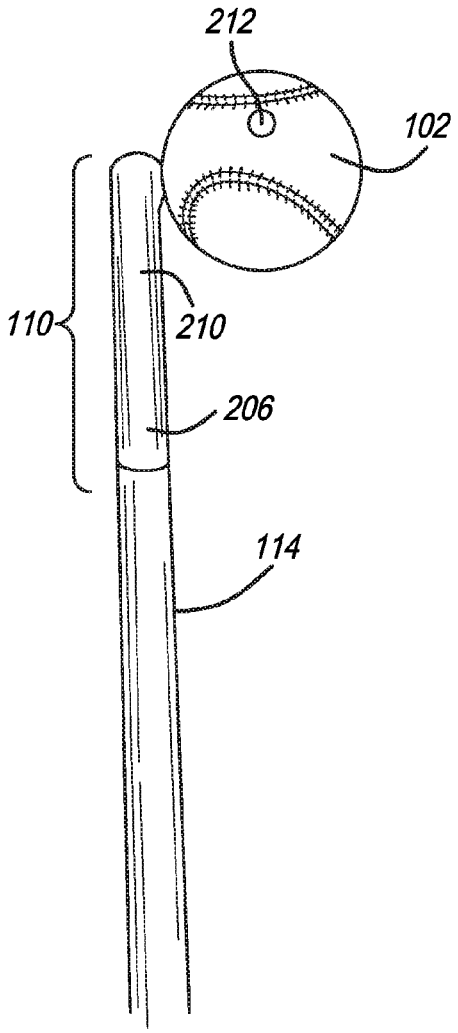

Referring now to FIGS. 2A and 2B, there are shown diagrams of one embodiment of the ball throwing training device 100, wherein the first ball-shaped object 102 is coupled to the head portion 110 at an angle to the head portion 114. The angle of coupling of the first ball-shaped object 102 to the head portion 114 can be any angle. FIG. 2A shows the head portion 110 with a mechanical means 202 of attachment coupled at approximately a 90 degree angle to the distal end of the head portion 110. The mechanical means 202 of attachment is coupled to the first ball-shaped object 102 via a receptor 204 in the first ball-shaped object 102. The mechanical means 202 can comprise any means of attaching the head portion 110 to the first ball-shaped object, such as, for example, a screw, nail, clip, snap, ball joint, or adhesive.

Additionally, it should be noted that the first ball-shaped object 102 can either remain stationary on the mechanical means 202 of attachment, or it can rotate about the mechanical means 202 as the user rotates their wrist during use of the device, as described in further detail below.

In one embodiment of the ball throwing training device 100, the head portion 110 can have a spacer 208 added to it extend the length of the head portion 110. This allows the ball throwing training device 100 to be adapted to users of varying heights. FIG. 2A shows the head portion 110 comprising a bottom piece 206, coupled to a spacer 208, which is then coupled to a top piece 210. The parts of the head portion 110 can be coupled by any means, such as, for example, a screw, nail, clip, snap, ball joint or adhesive. FIG. 2B shows the head portion 110 without a spacer 208, so that the bottom piece 206 is directly coupled to the top piece 210. Optionally, head portion 110 can be coupled to either a pivot joint 302 (as shown in FIGS. 3A-3C), or the head portion 110 coupled directly to the longitudinal body portion 114 (as shown in FIG. 1A).

Ball Throwing Training Device with Pivot Joint

It is also contemplated that the ball throwing training device of the present invention can have a moveable portion proximate to the distal end of the longitudinal body portion 114. The movable portion can be any means in order that the distal portion of the longitudinal body portion 114 can be moved. In one embodiment of a ball throwing training device with moveable portion, the ball throwing training device with pivot joint 300, the longitudinal body portion 114 is coupled to a pivot joint 302 (FIGS. 3A-3C). The pivot joint 302 causes either side of the longitudinal body portion 114 to which it is coupled to rotate about the pivot joint 302.

Figure 3A:
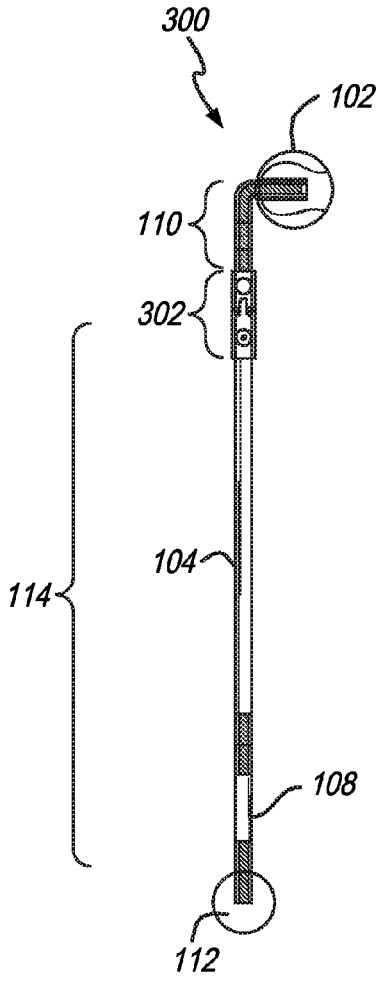
FIGS. 3A, 3B and 3C are diagrams of a ball throwing training device with a flexible portion in the distal end.
Figure 3B:
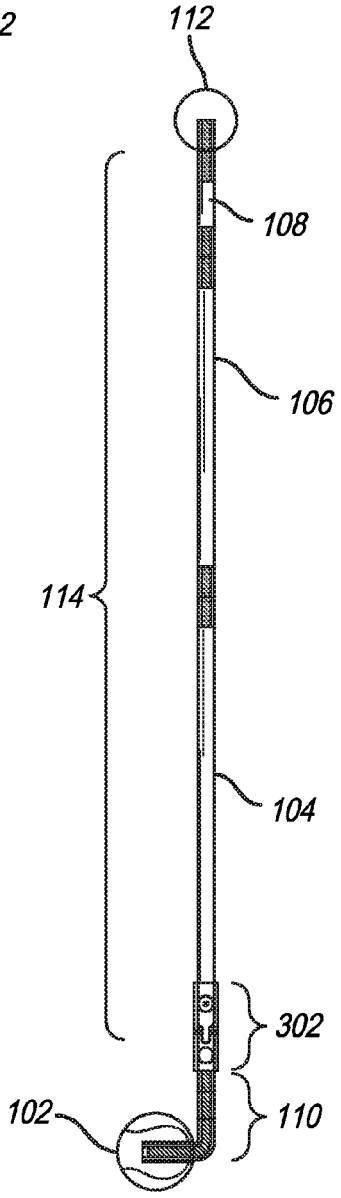
Figure 3C:
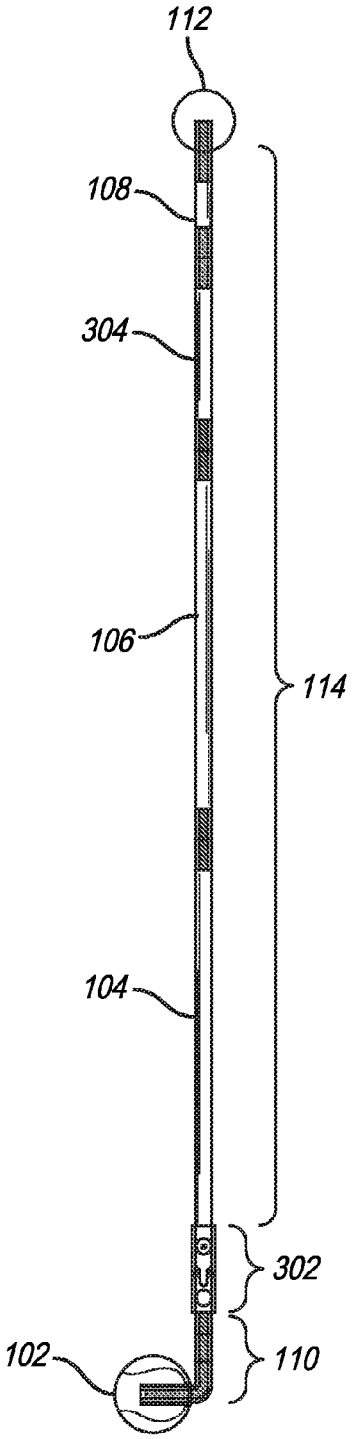

As with the ball throwing training device described above and shown in FIGS. 1A-1B and 2A-2B, the longitudinal body portion 114 can be adjusted by the use of any number of first, second and third segmented longitudinal body portions 104, 106, 108 in order to accommodate users of different heights (FIGS. 3A and 3B). FIG. 3C shows a fourth segmented longitudinal body portion 304 that can be added to the longitudinal body portion 114. The segmented longitudinal body portions can be coupled together in any order via any mechanical means, such as, for example, a screw, nail, clip, snap, ball joint or adhesive.

The longitudinal body portion 114, the first, second, third and fourth segmented longitudinal body portions 104, 106, 108, and 304, and the head portion 110 can be made from any inflexible material such as, for example, fiberglass, metal, plastic, wood, aluminum, steel, carbon fiber, steel alloy, copper tubing, bamboo, paper, glue, rubber, glass, tin, leather or brass.

As with the ball throwing training device 100 previously described, the ball throwing training device with pivot joint 300 can have a first ball-shaped object 102 coupled to the distal end of the longitudinal body portion 114, and optionally a second ball-shaped object 112 can be coupled to the proximal end of the longitudinal body portion 114.

Figure 4A:
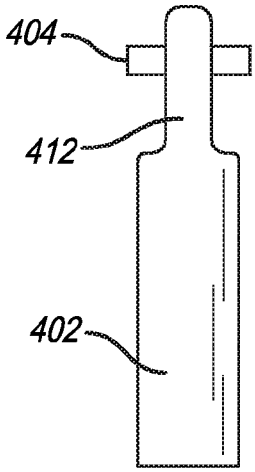
FIGS. 4A, 4B, 4C and 4D are diagrams of exploded views of the flexible portion of the ball throwing training device.
Figure 4B:
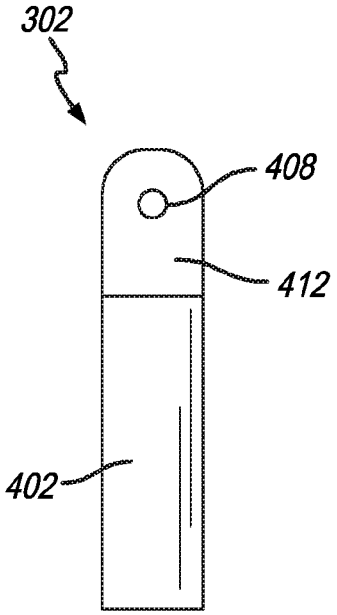
Figure 4C:
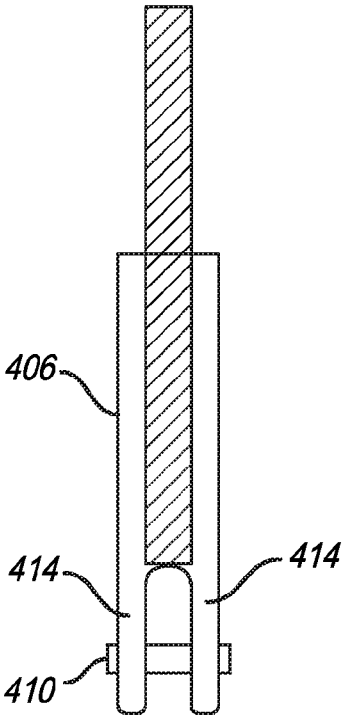
Figure 4D:
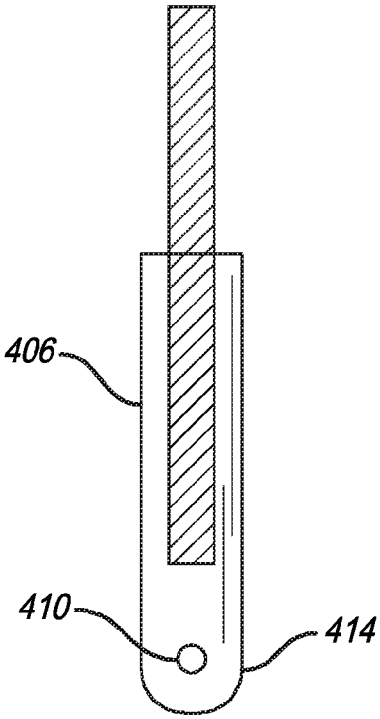

FIGS. 4A, 4B, 4C and 4D show exploded views of the movable pivot joint 302. The movable pivot joint 302 comprises a top piece 402 and a bottom piece 406. FIG. 4A shows a view of the top piece 402 with pivot pin 404 of the movable pivot joint 302 from the top and FIG. 4B shows a view of the top piece 402 from the side. FIG. 4C is a view of the bottom piece 406 with pivot pin 404 from the top and FIG. 4D is a view of the bottom piece 406 from the side. Pivot pin 404 holds the top piece 402 and bottom piece 406 together. The top piece 402 has a first hole 408 for the pivot pin 404 to pass through. The bottom piece 406 has a second hole 410 for the pivot pin 404 to pass through. The top piece 402 has an elongated portion 412, which is designed to fit between the two extensions 414 of the bottom piece 406. When the elongated portion 412 from the top piece 402 is sandwiched between the two extensions 414 of the bottom piece 406, the first hole 408 and the second hole 410 line up, and the pivot pin 404 passes through and creates the movable pivot joint 302. Optionally, the movable pivot joint 302 can have a means for locking the pivot joint, making the pivot joint unmovable, as described further below.

Figure 5A:
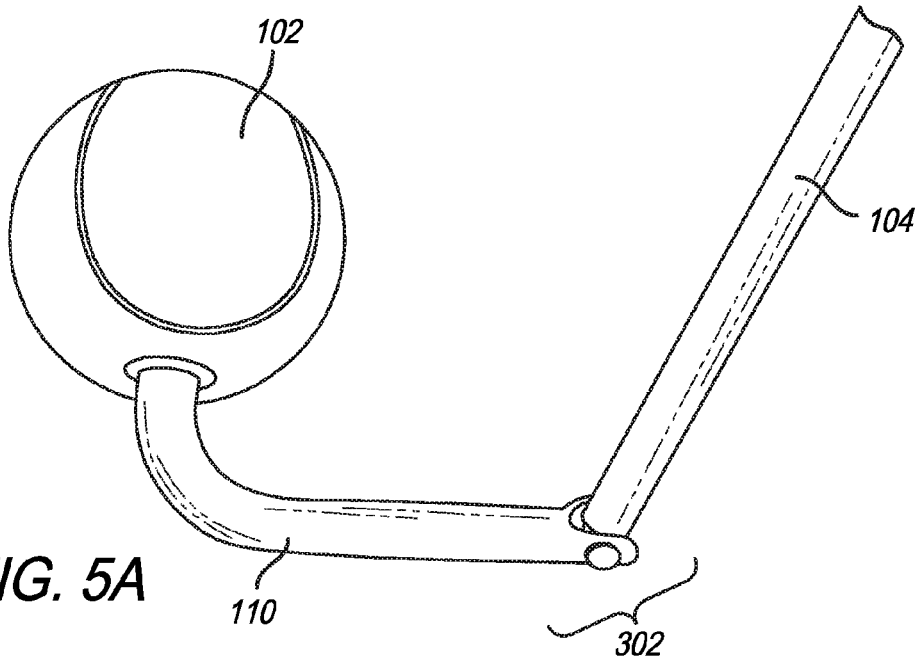
FIGS. 5A and 5B are diagrams showing the movement of the flexible portion of the ball throwing training device.
Figure 5B:
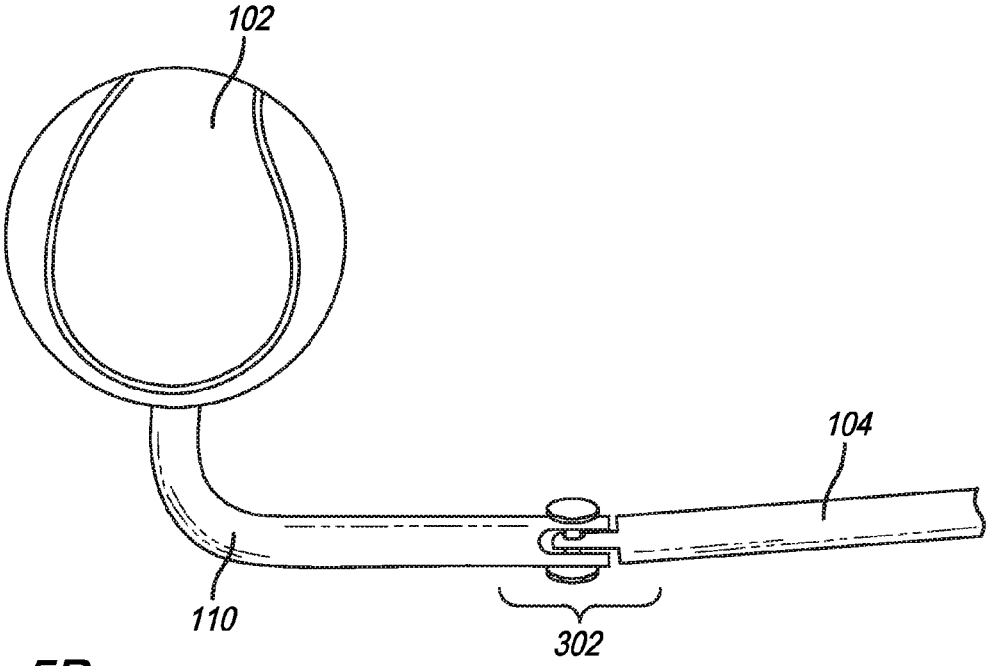

FIGS. 5A and 5B show the motion that the movable pivot joint 302 provides for the ball throwing training device with pivot joint 300. FIG. 5A shows the movable pivot joint 302 before it is pivoted by the user. FIG. 5B shows the movable pivot joint 302 in the pivoted position. The longitudinal body portion 114 remains stationary while the head portion 110, while the first ball-shaped object 102 attached to the distal end of the head portion 110 pivots to the desired position.

Figure 6:
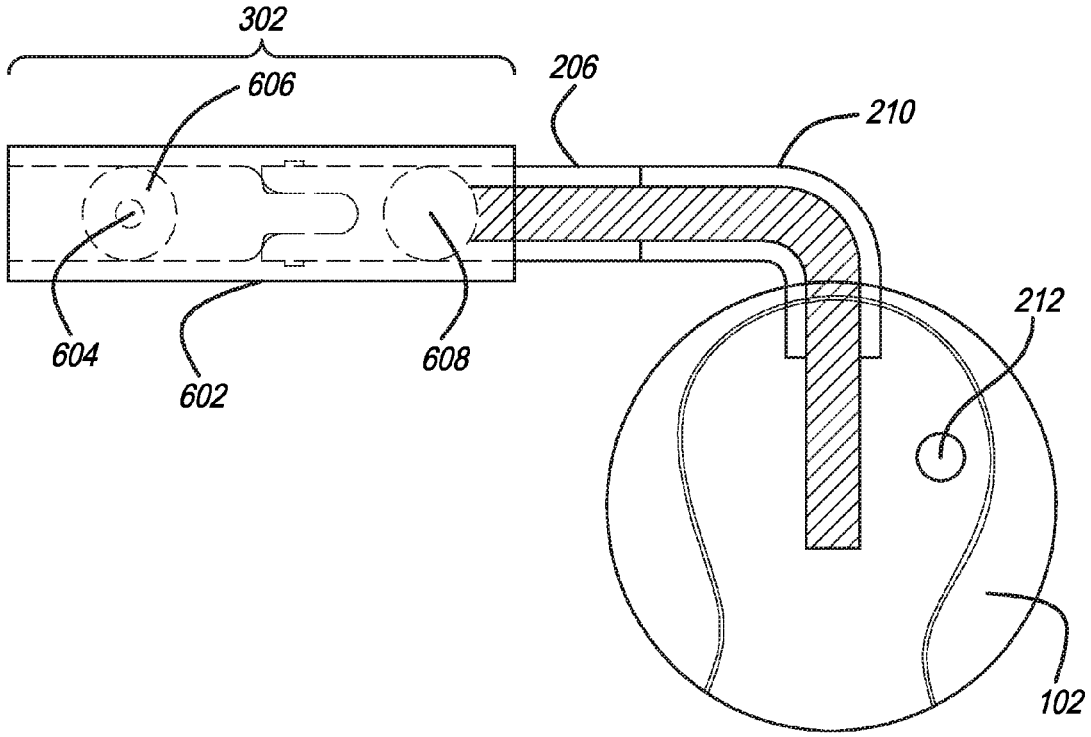
FIG. 6 is a diagram of an exploded view of the flexible portion of the ball throwing training device.

Referring now to FIG. 6, there is shown a diagram of a locking mechanism 602 that is designed to lock the pivot joint 302 in a straight position. The locking mechanism 602 can be in the form of a sleeve that slides up and around the pivot joint 302, preventing the pivot joint 302 from moving. Optionally, the locking mechanism 602 can be spring loaded to provide easy use.

Optionally, the locking mechanism 602 can comprise a first opening 606 and a second opening 608. There can also be a button 604, which can be located in the bottom piece 406 of the pivot joint 302. The button 604 can be spring loaded for easy use. When the locking mechanism 602 is in the "unlocked" position, the locking mechanism 602 is below the pivot joint 302, and the button 604 is extending up through the second opening 608 in the locking mechanism 602. To activate the locking mechanism 602 and move it into the "locked" position, the user must depress the button 604 out of the second opening 608, slide the locking mechanism 602 up and over the pivot joint, and allow the button 604 to extend up through the first opening 606 in the locking mechanism 602, which prevents the locking mechanism 602 from sliding off the pivot joint 302. To disengage the locking mechanism 602, the user depresses the button 604 out of the first opening 606, slides the locking mechanism 602 down and off the pivot joint 302, and allows the button 604 to extend up through the second opening 608.

Ball Throwing Training Device with Flexible Portion

Figure 7C:
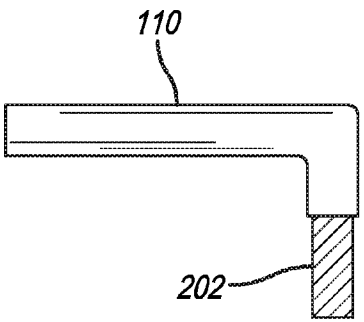
FIGS. 7A, 7B and 7C are diagrams of an example of the flexible portion of the ball throwing training device.
Figure 7B:
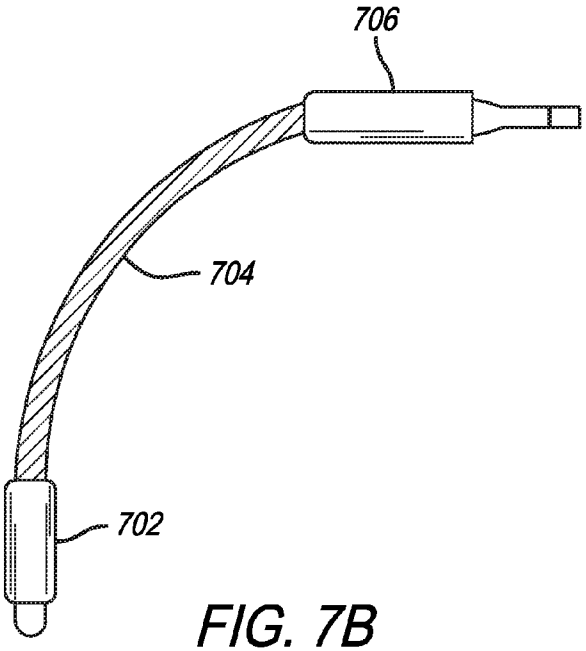
Figure 7A:
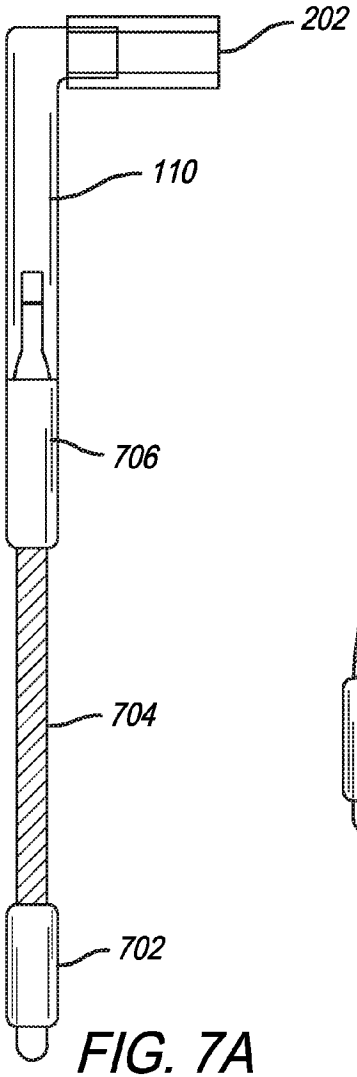

It is also contemplated that the moveable portion is made out of flexible material. Referring now to FIGS. 7A, 7B and 7C, in one embodiment of the ball throwing training device 100, the longitudinal body portion 114 is coupled to a flexible portion 704. The flexible portion 704 has first connector 702 on the proximal end of the flexible portion 704. The first connector 702 can be coupled to the distal end of the longitudinal body portion 114. The flexible portion 704 also has a second connector 706 attached to the distal end of the flexible portion 704. The second connector 706 is coupled to the proximal end of head portion 110. The distal end of head portion 110 has a mechanical means 202 to couple to the first ball-shaped object 102.

The flexible portion 704 is designed to be freely manipulated in any direction by the user, to achieve the desired positioning with very minimal effort. This allows for easy accommodation of users still recovering from injuries. Due to the injuries they may not be able to achieve the desired throwing position.

Figure 14:
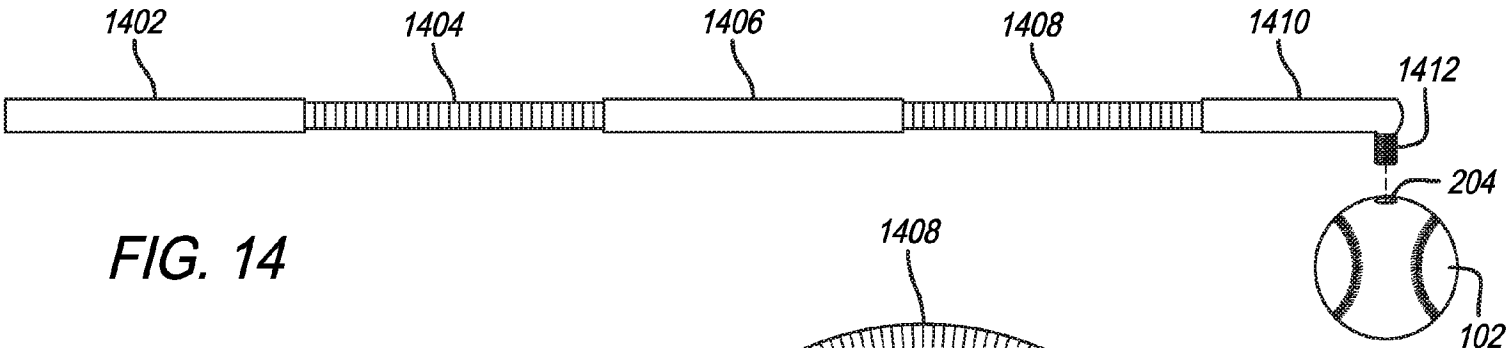
FIG. 14 is a diagram of an embodiment of the ball throwing training device wherein the device comprises two flexible portions.
Figure 15:
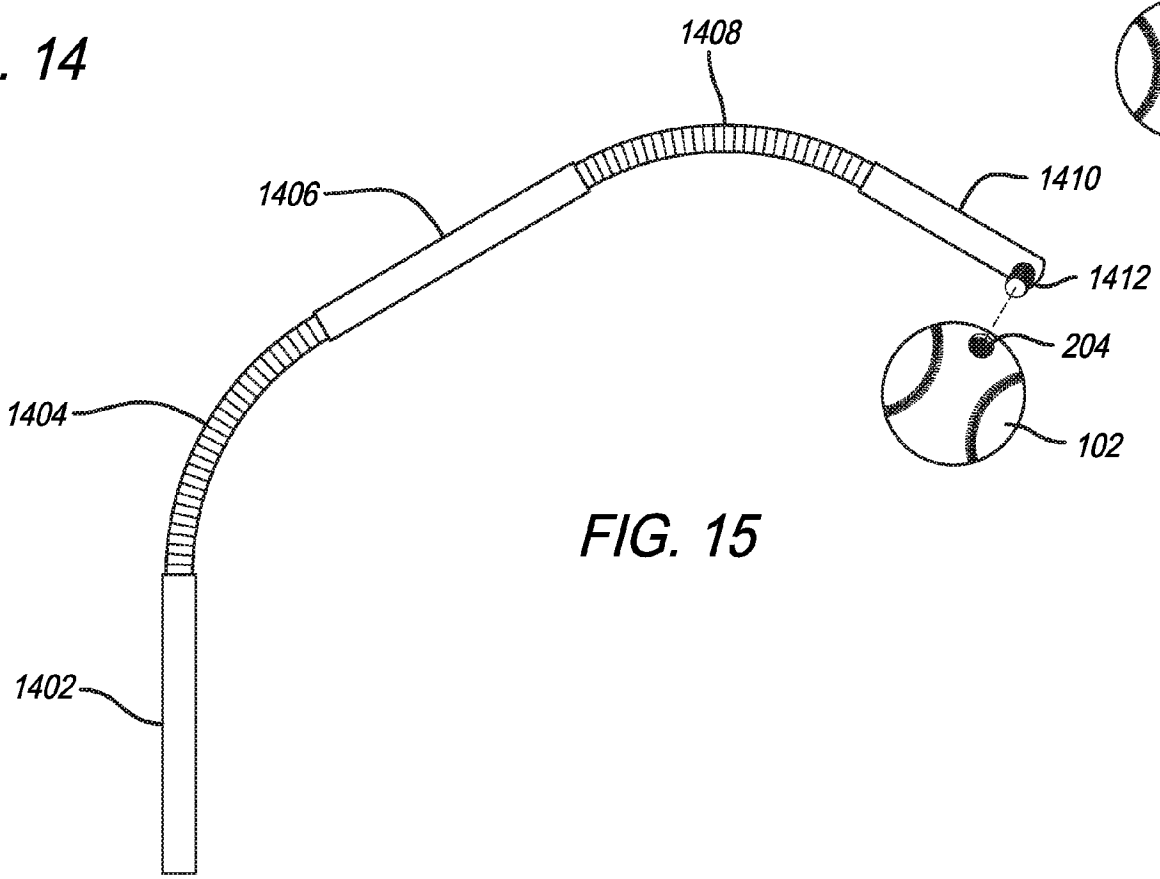
FIG. 15 is a diagram of an embodiment of the ball throwing training device according to FIG. 14, wherein the two flexible portions are flexed.

Referring now to FIGS. 14 and 15, in one embodiment of the ball throwing training device 100 there is a first and a second longitudinal body portion 1402, 1406, a first and a second flexible portion 1404, 1408 and a first ball shaped object 102. The first and second longitudinal body portions 1402, 1406 and the first and second flexible portions 1404, 1408 each have a proximal end and a distal end. The distal end of the first longitudinal body portion 1402 can be coupled to the proximal end of the first flexible portion 1404, the distal end of the first flexible portion 1404 can be coupled to the proximal end of the second longitudinal body portion 1406, the distal end of the second longitudinal body portion 1406 can be coupled to the proximal end of the second flexible portion 1408, and the distal end of the second flexible portion 1408 can be coupled the first ball shaped object 102. Optionally, the device 100 can further comprise a third longitudinal body portion 1410 that has a proximal end and a distal end. The proximal end of the third longitudinal body portion 1410 can be coupled to the distal end of the second flexible portion 1408 and the first ball shaped object 102 can be coupled to the distal end of the third longitudinal body portion 1410.

The first, second and third longitudinal body portions, 1402, 1406, and 1410, can be made from any inflexible material such as, for example, fiberglass, metal, plastic, wood, aluminum, steel, carbon fiber, steel alloy, copper tubing, bamboo, paper, glue, rubber, glass, tin, leather or brass. The first, second, and third longitudinal body portions, 1402, 1406, and 1410 can be coupled together in any order via any mechanical means, such as, for example, a screw, nail, clip, snap, ball joint or adhesive. Preferably they are coupled together via a set screw.

Optionally, the end cap 1002 or the second ball shaped object 112 can be coupled to the proximal end of the first longitudinal body portion 1402. Both the end cap 1002 and the second ball shaped object 112 can move between an extended position and a retracted position, as can be seen in FIGS. 10 through 13.

As can also be seen in FIGS. 14 and 15, the first ball-shaped object 102 is coupled to the third longitudinal body portion 1410 at an angle to the third longitudinal body portion 1410. The angle can be any angle, but preferably it is a 90 degree angle. FIGS. 14 and 15 show the third longitudinal body portion 1410 with a mechanical means 1412 of attachment coupled at approximately a 90 degree angle to the distal end of the third longitudinal body portion 1410. The mechanical means 1412 of attachment is coupled to the first ball-shaped object 102 via a receptor 204 in the first ball-shaped object 102. The mechanical means 1412 can comprise any means of attaching the third longitudinal body portion 1410 to the first ball-shaped object 102, such as, for example, a screw, nail, clip, snap, ball joint, or adhesive.

Optionally, the first and second flexible portions, 1404, 1408 can have a means for locking the flexible portions, making the flexible portions unmovable. The locking mechanism can be made from any material, including plastic, metal or rubber, and the locking mechanism can comprise any means for making the flexible portions unmovable.

For example, the locking mechanism can comprise one or more sleeves which slide over the flexible portions 1404, 1408, and do not allow the flexible portions 1404, 1408 to flex, similar to the sleeve described above with reference to the pivot joint 302. The cross-section of the sleeve could be any shape. For example, the sleeve could fully surround the flexible portions 1404, 1408, having a cross section that was circular. Optionally, the cross-section of the sleeve could be C-shaped, in that it does not fully surround the flexible portions 1404, 1408.

Optionally, the locking mechanism could be removably coupled to the flexible portion. The locking mechanism can have two opposed end portions which couple to opposed ends of the flexible portion, and are connected together by a rigid rod. The opposed end portion of the locking mechanism can have cross section that is C-shaped, permitting the user to press the end portions of the locking mechanism onto the opposed ends of the flexible portion. The rod has a longitudinal axis that is parallel to the longitudinal axis of the first flexible portion 1404, preventing the first flexible portion 1404, from flexing.

Ball Throwing Training Device with Straps or Harness

Figure 9A:
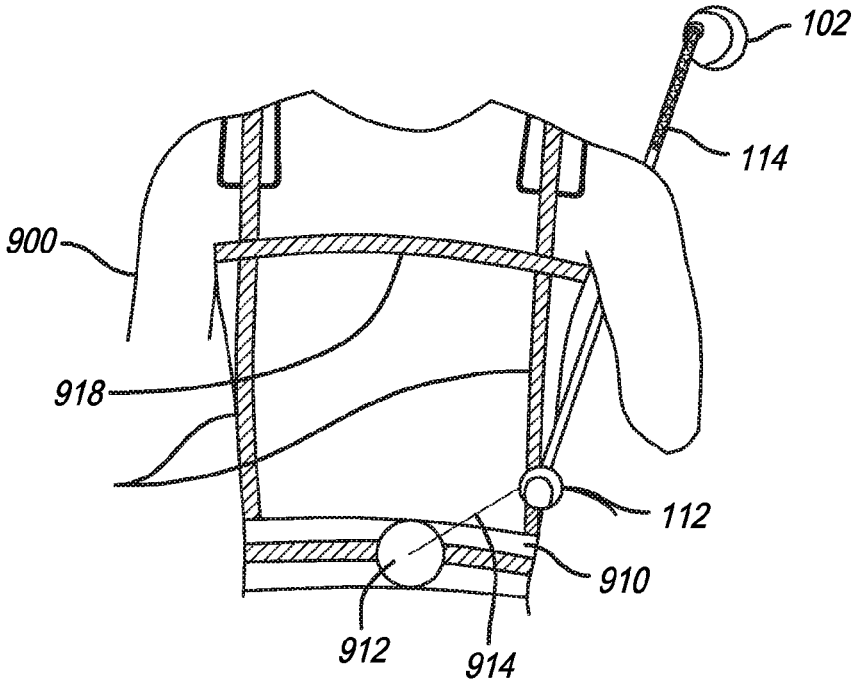
FIGS. 9A and 9B are diagrams of a harness affixed to the ball throwing training device.
Figure 9B:
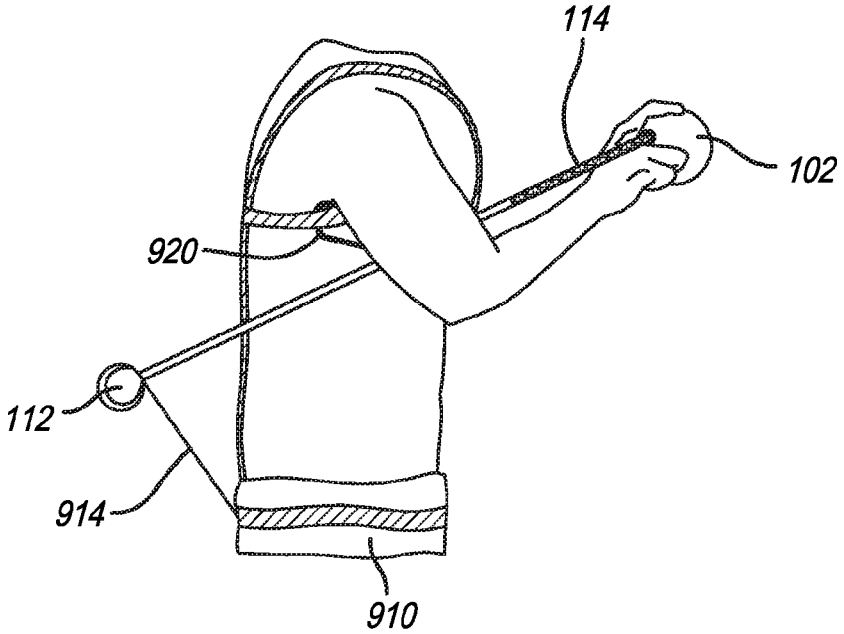

It is contemplated that the ball throwing training device 100 can contain a means for attaching the ball throwing training device 100 to the user. In one embodiment with a harness, the proximal end of the longitudinal body portion 114 can be coupled to a waist belt or harness to secure the ball throwing training device 100 to the user in the correct position. The use of a harness 900 is shown in FIGS. 9A and 9B. The harness 900 is attached to the user's waist by a first belt 910. The harness can optionally have straps 916 that extend from the first belt 910 horizontally across the user's back and is fastened around the users chest and upper back by means of a second belt 918. The second ball-shaped object 112 is attached to the first belt 910 at a location 912 in the center of the user's lower back by a first flexible means 914, such as an elastic strap or retractable cord. The harness can also be attached to the second belt 918 by a second flexible means 920, such as an elastic strap or retractable cord.

In another embodiment of the ball throwing training device 100, the proximal end of the first longitudinal body portion 114 can be strapped to the user's arm in order to secure the ball throwing training device 100 in the correct position (not shown). The straps can be located around the user's wrist and bicep.

A harness 900 or straps can also be used with the ball throwing training device with pivot joint 300 or flexible portion 704.

Use of the Ball Throwing Training Device

Figure 8A:
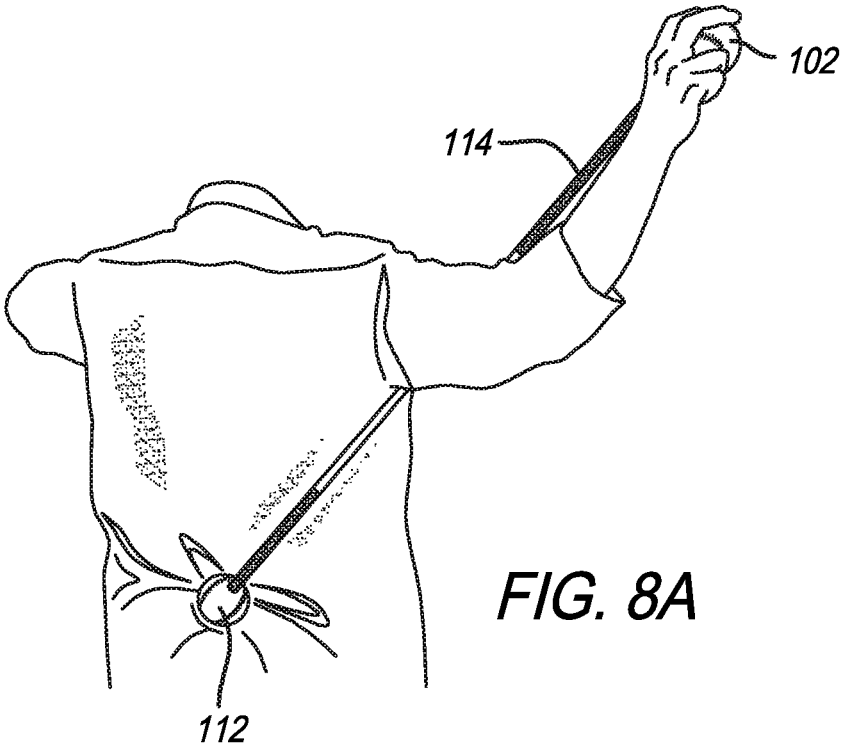
FIGS. 8A and 8B are diagrams of the ball throwing training device in use.
Figure 8B:
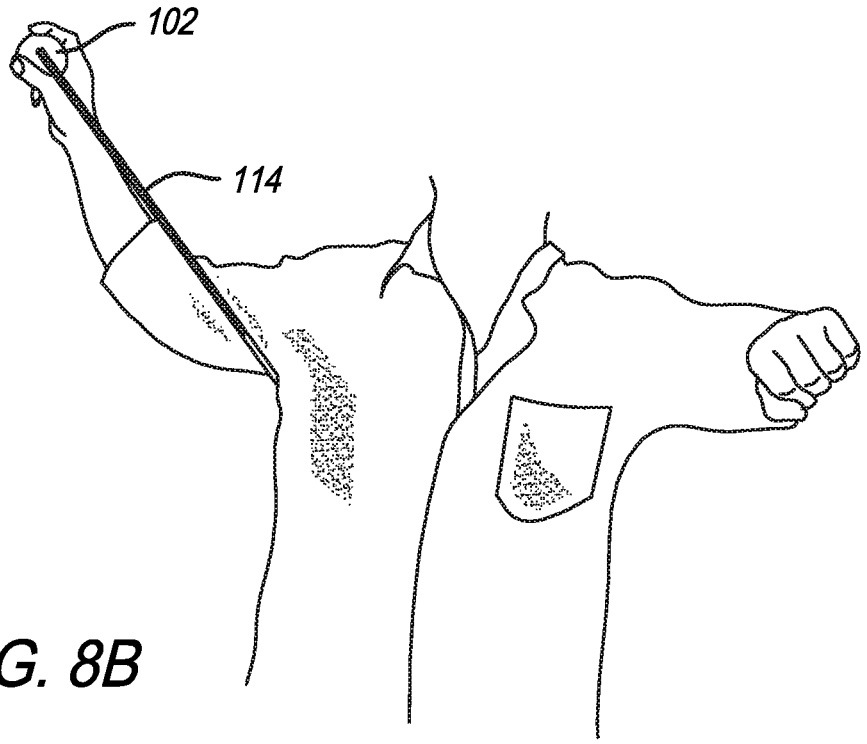

FIGS. 8A and 8B depict the method of using the ball throwing training device 100. The placement of the ball throwing training device 100 and movement allowed by the ball throwing training device 100 corrects the user's form, and aligns the user's elbow properly in order to avoid improper throwing form the damaging side-arm motion. The user grasps the first ball-shaped object 102 in either hand, and positions either the proximal end of the longitudinal body portion 114, or the second ball-shaped object 112, against their lower back, so that the longitudinal body portion 114 runs along the back of the user, against the user's side, under the user's arm and along the user's forearm. The user then raises their hand and arm to the desired starting position, which is ideally above shoulder height. The user then moves the ball into a second ending position that is lower than the starting position. The user moves the ball by rotating their arm forward such that the ending position is below the user's shoulder. This rotation forward can also involve some rotation of the wrist forward as well. This movement will cause the first ball-shaped object to rotate on the head portion 110, and causes the proximal end of the longitudinal body portion to move away from the user's lower back. However, the longitudinal body portion will remain against the user's side.

In the case of a ball throwing training device with pivot joint 300, the device starts in the same starting position as described above for the ball throwing training device 100. The user then moves the ball into an ending position that is lower than the starting position by rotating their arm forward. In use, the first ball shaped object is stationary relative to the head portion 110, and only the movable pivot joint 302 moves during use. FIG. 5A shows the movable pivot joint 302 in the starting position. FIG. 5B shows the movable pivot joint 302 in the ending position.

Similarly, in the ball throwing training device with flexible portion 704, the user holds the device in the starting position. The user then moves the ball into an ending position that is lower than the starting position. In use, the first ball shaped object is stationary relative to the head portion 110, and only the movable flexible portion 704 moves during use, and then automatically returns to the starting position.

When used with a harness 900, the user attaches the harness 900 by means of the first belt 910 and optional second belt 918. The second ball-shaped object 112 is attached to the first belt 910 at a location 912 in the center of the user's lower back by a first flexible means 914, such as an elastic strap or retractable cord. The harness can also be attached to the second belt 918 by a second flexible means 920, such as an elastic strap or retractable cord. The user grasps the first ball-shaped object 102 in the first starting position and moves it to the ending position. The second ball-shaped object 112 moves from a first position to a second position when the first ball-shaped object 102 is moved from the first starting position to the ending position. The harness in combination with the first flexible means 914 can provide resistance for the user's muscles.

Use of the Device as an Arm and Shoulder Strengthening Device

It is also contemplated that any of the ball throwing devices described above can be used as an arm and shoulder strengthening device. The movement described above can strengthen areas of the arm and shoulder. In use, the device engages the user's arm, shoulder, neck and trunk muscles, such as, for example, forearm flex muscles, forearm extensor muscles, biceps, triceps, deltoids, chest muscles, side muscles, and trapezius muscles. The device can be used in physical or occupational therapy as an aid to strengthen a user's arm, shoulder, and trunk muscles.

A Software Application for Use with the Ball Throwing Training Device

The present invention also comprises a software application for use with the ball throwing training device 100. The software application (not shown) can be downloaded onto any electronic device, including any mobile device, preferably a mobile phone or tablet. The software application would allow the user to use the software application at any location that practice is taking place. A sensor 212 can be located anywhere along the ball throwing device 100. In one embodiment, as shown in FIGS. 2A and 2B, the sensor 212 can be located proximate to the first ball shaped object 102. Optionally, the sensor 212 can be coupled directly to the user, preferably on the user's hand or arm that is performing the throwing motion. The sensor 212 can be coupled to the user via any means, but one embodiment of the present invention comprises the sensor 212 coupled to an elastic or flexible band (not shown) which can be wrapped around a part of the user. The elastic or flexible band provides an easily adjustable means of coupling the sensor 212 to the user. It also permits the sensor 212 to be moved from one user to another as it can easily be adjusted to accommodate users of different size.

The sensor 212 can be any type of sensor such as a Bluetooth sensor, a gyroscopic sensor, an impact sensor, a position sensor, a rate sensor, a repetition counting sensor, a tilt sensor, and a velocity sensor. The sensor 212 can be wirelessly linked to the software application through the use of radio waves, wireless networks, and broadband. Once the sensor 212 is wirelessly linked to the software application, it tracks the user's movement of the ball throwing training device and provides the data to the software application. The user can then view the data on the software application, and the software application will inform the user whether they are using the ball throwing training device properly, and how to correct their throwing movement if they are not throwing with the correct form. Other data can be generated by the software application such as speed of throw and length of practice.

Although the present invention has been described in considerable detail with reference to certain preferred embodiments, other embodiments are possible. The steps disclosed for the present methods, for example, are not intended to be limiting nor are they intended to indicate that each step is necessarily essential to the method, but instead are exemplary steps only. Therefore, the scope of the appended claims should not be limited to the description of preferred embodiments contained in this disclosure. All references cited herein are incorporated by reference in their entirety.

What is claimed is:

1. A method of using a ball throwing training device, the device comprising a longitudinal body portion, the longitudinal body portion comprising a proximal end and a distal end, and a ball-shaped object, the ball-shaped object being coupled to the distal end of the longitudinal body portion, the method comprising the steps of:

a) a user grasping the ball-shaped object in the user's hand;

b) placing the longitudinal body portion underneath the user's arm against the user's side;

c) placing the proximal end of the longitudinal body portion against the lower back of the user such that the user's hand holding the first ball-shaped object is above shoulder height; and d) rotating the user's arm forward such that the hand holding the ball-shaped object rotates from above the user's shoulder below the user's shoulder;

wherein rotation of the user's arm forward lifts the proximal end of the longitudinal body portion.

2. The method of claim 1, wherein the longitudinal body portion comprises two or more longitudinal body portions of variable size.

3. The method of claim 1, further comprising the step of the user returning the proximal end of the longitudinal body portion against the lower back of the user.

4. The method of claim 1, wherein steps a) through d) are repeated one or more times.

5. A method of using a ball throwing training device, the device comprising a longitudinal body portion, the longitudinal body portion comprising a proximal end and a distal end, wherein an end cap is coupled to the proximal end of the first longitudinal body portion, and a first ball-shaped object coupled to the distal end of the first longitudinal body portion, the method comprising the steps of:

a) a user grasping the first ball-shaped object in the user's hand;

b) placing the longitudinal body portion underneath the user's arm against the user's side;

c) placing the proximal end of the longitudinal body portion against the lower back of the user such that the user's hand holding the first ball-shaped object is above shoulder height; and d) rotating the user's arm forward such that the hand holding the first ball-shaped object rotates from above the user's shoulder below the user's shoulder;

wherein rotation of the user's arm forward lifts the proximal end of the longitudinal body portion.

6. The method of claim 5, wherein the device further comprises a second longitudinal body portion comprising a proximal end and a distal end, wherein the proximal end of the second longitudinal body portion is coupled to the distal end of the first longitudinal body portion, and the first ball-shaped object coupled to the distal end of the second longitudinal portion.

7. The method of claim 5, further comprising the step of the user returning the proximal end of the first longitudinal body portion against the lower back of the user.

8. The method of claim 5, wherein steps a) through d) are repeated one or more times.

* * * * *